United States Patent [19]

Chikaraishi et al.

[11] Patent Number: 5,048,838

[45] Date of Patent: Sep. 17, 1991

[54] THREE-PIECE SOLID GOLF BALL

[75] Inventors: Toshio Chikaraishi, Akishima; Hidetoshi Ieiri, Kodaira; Kazuhiko Sugai; Kazuto Maehara, both of Yokohama, all of Japan

[73] Assignee: Bridgestone Corporation, Tokyo, Japan

[21] Appl. No.: 493,644

[22] Filed: Mar. 15, 1990

[30] Foreign Application Priority Data

Mar. 15, 1989 [JP] Japan ..... 1-063306

[51] Int. Cl.[5] ..... A63B 37/06

[52] U.S. Cl. ..... 273/228; 273/230

[58] Field of Search ..... 273/220, 228, 62, 230, 273/218, 219, 225, 229

[56] References Cited

U.S. PATENT DOCUMENTS 4,625,964 12/1986 Yamada ..... 273/62

4,714,253 12/1987 Nakahara et al. ..... 273/228

4,848,770 7/1989 Shama ..... 273/228

FOREIGN PATENT DOCUMENTS 2196538 5/1988 United Kingdom ..... 273/220

*Primary Examiner*—George J. Marlo

*Attorney, Agent, or Firm*—Sughrue, Mion, Zinn Macpeak & Seas

[57] ABSTRACT

The inner layer of the core has a diameter of 15–25 mm, a weight of 2–14 grams, a specific gravity of 1.2–4, and a hardness of 55–80 JIS C. The outer layer has a specific gravity lower than that of the inner layer by 0.1–3.0. The cover has a radial thickness of 1.5–2.5 mm.

A three-piece solid golf ball comprising a two-piece solid core consisting of inner and outer layers and a cover enclosing the core is improved in durability and flying performance through a proper choice of physical parameters of the core inner and outer layers and the cover.

8 Claims, 1 Drawing Sheet

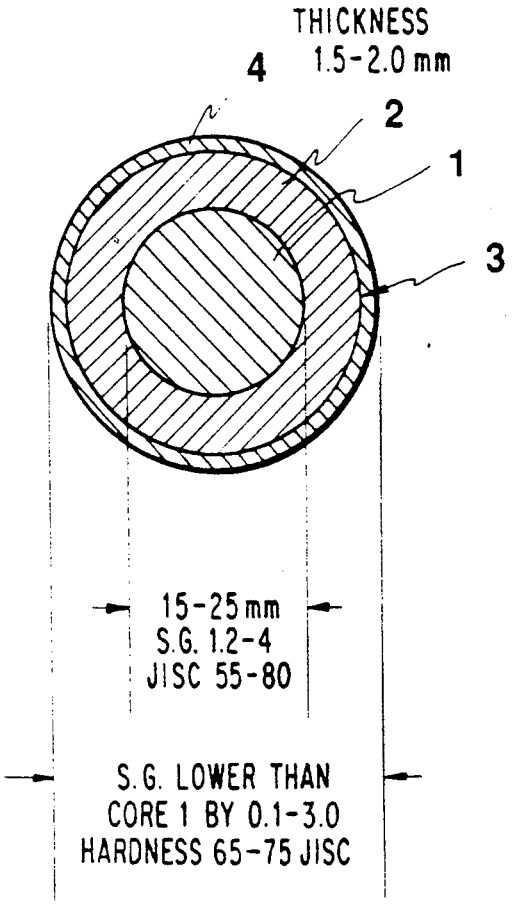
THICKNESS
1.5-2.0 mm
4
2
1
3
15-25 mm
S.G. 1.2-4
JISC 55-80
S.G. LOWER THAN
CORE 1 BY 0.1-3.0
HARDNESS 65-75 JISC

THREE-PIECE SOLID GOLF BALL

This invention relates to a three-piece solid golf ball which is improved in hitting feel, controllability, flying performance, and durability.

BACKGROUND OF THE INVENTION

The current mainstream of solid golf balls is a two-piece solid golf ball of the two-layer structure consisting of a core and a cover enclosing the core because of flying performance and durability. As compared with the thread-wound golf ball, the two-piece solid golf ball suffers from low control and an unfavorable feel upon hitting. A newly proposed solid golf ball having higher control and a favorable feel upon hitting is a three-piece solid golf ball which includes a two-piece solid core consisting of an inner layer and an outer layer and a cover enclosing the core. The three-piece solid golf ball, however, is less durable as compared with the two-piece ball. It is thus desired to develop a three-piece solid golf ball which is improved in controllability, hitting feel, and durability. A further increase in flying distance is also desired because most golf players love balls with increased flight.

SUMMARY OF THE INVENTION

An object of the present invention is to provide a three-piece solid golf ball which is improved in durability and flight performance while maintaining the controllability and feel characteristic of the three-piece solid golf ball.

The inventors have found that the above and other objects can be attained by a proper choice of parameters of the components of a three-piece solid golf ball, more particularly by optimizing the diameter, weight, specific gravity, and hardness of the core inner layer and the ratio in specific gravity of the core inner layer to the core outer layer.

More specifically, a three-piece solid golf ball having improved controllability, hitting feel, durability and flight performance is obtained when the inner layer has a diameter of 15 to 25mm, a weight of 2 to 14 grams, a specific gravity of 1.2 to 4, and a hardness of 55 to 80 in JIS C hardness scale, the outer layer has a lower specific gravity than that of the inner layer, and the cover has a radial thickness of 1.5 to 2.5mm.

BRIEF DESCRIPTION OF THE DRAWING

The above and other objects, features, and advantages of the present invention will be better understood from the following description taken in conjunction with the accompanying drawing, in which:

the only figure is a cross-sectional view of a three-piece solid golf ball.

DESCRIPTION OF THE PREFERRED EMBODIMENTS

Referring to the accompanying figure, there is illustrated a three-piece solid golf ball according to the present invention. The ball includes a core 3 of a two-layer structure consisting of an inner layer 1 and an outer layer 2. The core 3 is enclosed in a cover 4. According to the present invention, the core inner layer 1 has a diameter of 15 to 25mm, a weight of 2 to 14 grams, a specific gravity of 1.2 to 4, and a hardness of 55 to 80 in JIS C hardness scale (JIS K 6301). The core outer layer 2 has a lower specific gravity than that of the core inner layer 1. The cover 4 surrounding the core 3 has a radial thickness of 1.5 to 2.5mm.

The core inner layer 1 is a sphere as seen from the figure. Ball rebound or repulsion is least improved when the diameter of the core inner layer 1 is smaller than 15mm. With a diameter of larger than 25mm, repulsion is improved, but durability is lost. When the core inner layer 1 has a weight of less than 2 grams or more than 14 grams, the inherent properties of a three-piece solid golf ball are lost. Small benefits of the invention are available when the core inner layer 1 has a specific gravity of lower than 1.2 approaching to that of the core outer layer. A specific gravity of higher than 4 results in a too heavy ball falling outside the golf ball standard. Repulsion and durability are less desirable when the core inner layer 1 has a hardness of lower than 55 in JIS C hardness scale. A hard core inner layer harder than 80 in JIS C hardness scale results in a ball with a poor hitting feel.

Most preferably, the core inner layer 1 has a diameter of 18 to 23mm, a weight of 5 to 12 grams, a specific gravity of 1.5 to 3, and a hardness of 65 to 75 according to JIS C hardness.

The core outer layer 2 should have a lower specific gravity than that of the core inner layer 1. If the specific gravity of the core outer layer 2 is equal to or higher than that of the core inner layer 1, the overall weight of the ball becomes too large, failing to meet the golf ball standard. The specific gravity of the core outer layer 2 is preferably lower than that of the core inner layer 1 by 0.1 to 3.0, more preferably by 0.4 to 1.5. The core outer layer 2 preferably has a hardness of 65 to 75 in JIS C hardness scale. The thickness and weight of the outer layer 2 is adjusted in relation to the diameter and weight of the inner layer 1 and the thickness and weight of the cover 4 such that the overall ball may have a diameter of at least 42.67 mm and a weight of up to 45.92 grams in the case of large balls and a diameter of at least 41.15 mm and a weight of up to 45.92 grams in the case of small balls.

The cover 4 surrounding the core 3 has a thickness of from 1.5 to 2.5 mm, preferably from 1.8 to 2.3 mm in a radial direction. A cover thinner than 1.5 mm is less durable whereas a cover thicker than 2.5 mm is less repulsive.

The inner and outer layers 1 and 2 of the core 3 are generally formed from a rubber composition which may be a commonly used rubber composition comprising a base rubber, a crosslinking agent, a co-crosslinking agent, a filler and other optional additives. The specific gravity, hardness and other factors of the composition can be adjusted to the above-defined ranges by varying the blending formulation and curing conditions.

The base rubber used in the rubber composition may be selected from natural rubbers and synthetic rubbers commonly used in the manufacture of conventional solid golf balls. Preferably, 1,4-polybutadiene having at least 40 mol %, preferably 80 to 100 mol % of a cis-structure is used. If desired, the polybutadiene may be blended with another component such as natural rubber, polyisoprene rubber, and styrene-butadiene rubber in an amount of 0 to 20% by weight of the total rubber weight.

The crosslinking agents used herein include organic peroxides such as dicumyl peroxide and t-butyl peroxide, and azo compounds such as azobisisobutyronitrile, with the dicumyl peroxide being most preferred. The crosslinking agent may be blended in amounts of about 0.5 to 3.0 parts, preferably about 0.7 to 2.0 parts by weight per 100 parts by weight of the base rubber.

The co-crosslinking agents used herein include metals salts of unsaturated fatty acids, for example, zinc, aluminum, and calcium salts of unsaturated fatty acids having 3 to 8 carbon atoms, such as acrylic acid and methacrylic acid. The most preferred co-crosslinking agent is zinc acrylate (normal salt). The co-crosslinking agent is preferably blended in amounts of about 5 to 50 parts by weight per 100 parts by weight of the base rubber.

The fillers used herein include zinc oxide, barium sulfate, silica, calcium carbonate, zinc carbonate and other rubber fillers, with the zinc oxide being preferred. The amount of filler blended varies with the specific gravity of the core inner and outer layers and the overall weight of the ball. The filler is generally blended in amounts of from about 30 to about 300 parts by weight for the inner layer and from about 3 to about 30 parts by weight for the outer layer, both per 100 parts by weight of the base rubber. The amount of filler blended may be varied to change the hardness and specific gravity of the rubber composition.

The core inner layer 1 may be prepared from such a rubber composition by blending the above-mentioned components, milling in a commonly used mill such as a Banbury mixer and a roll mill, compression or injection molding the composition in a mold having a cavity for the core inner layer, and heat curing the molded product under selected conditions. The heat curing conditions include a sufficient temperature for the crosslinking and co-crosslinking agents to act, for example, at a temperature of about 140° to 170° C. for dicumyl peroxide crosslinking agent and zinc acrylate co-crosslinking agent, and other parameters such as a heating rate and heating time are adjusted so as to provide a hardness of 55 to 80 in JIS C hardness scale (JIS K 6301). A spherical solid core inner layer having a diameter of 15 to 25 mm and a weight of 2 to 14 grams is prepared in this way.

The core outer layer is formed on the core inner layer so as to circumferentially enclose the inner layer. A core outer layer-forming composition is prepared by blending and milling components similar to those used in the core inner layer-forming composition. The composition is applied onto the core inner layer in a concentric form by compression or injection molding in a mold. The two-layer molded product is heat cured at a sufficient temperature for the crosslinking and co-crosslinking agents to act properly in the outer layer-forming composition, thereby completing a two-piece solid core. The core outer layer should be carefully formed such that the specific gravity of the outer layer is lower than that of the inner layer.

In addition to the above-mentioned components, the rubber composition from which the two-piece solid core is formed may have further blended therein plasticizers, antioxidants, and any other additives commonly used in the manufacture of the core of conventional solid golf balls.

The two-piece solid core thus prepared is coated with a cover of 1.5 to 2.5 mm thick. The cover may be formed of a composition comprising a major amount of an ionomer resin and an optional inorganic filler added for coloring and other purposes, for example, titanium dioxide and zinc oxide.

The ionomer resin used herein is preferably a thermoplastic resin in the form of a polymer of a monoolefin with at least one unsaturated mono- or dicarboxylic acid having 3 to 8 carbon atoms or an ester thereof, preferably such a polymer containing 4 to 30% by weight of an unsaturated mono-or dicarboxylic acid and/or an ester thereof, having a crosslinking metal bond imparted thereto. Typical ionomer resins are "Surlyn®" commercially available from E. I. duPont, for example, Surlyn 1601, 1707, 1605 and mixtures thereof, and "Hymilan®" commercially available from Mitsui duPont K.K.

It is not critical how the solid core is enclosed with the cover. Usually, the solid core is enclosed in a pair of preformed semi-spherical cover segments, followed by forming under heat and pressure. An alternative method is by injection molding the cover composition over the solid cover. The cover may be provided with dimples in any desired pattern.

The present invention may be applied to any type of golf ball including small balls having a diameter of at least 41.15 mm and a weight of up to 45.92 g, and large balls having a diameter of at least 42.67 mm and a weight of up to 45.92 g.

EXAMPLE

Examples of the invention are given below by way of illustration and not by way of limitation.

EXAMPLES 1-4

Three- and two-piece solid golf balls of the large size were fabricated by first preparing two- and one-piece solid cores by a conventional technique from the compositions shown in Table 1 to the diameter, specific gravity, hardness, and weight shown in Table 1. Vulcanization was effected at 160° C. for 20 minutes. The cores were coated with the covers shown in Table 1. The balls were finished by surface polishing and lacquer coating.

The balls were examined for flight performance, durability, feel, and control by the following tests.

Flying Performance

Using a swing robot (manufactured by True Temper K.K.) equipped with a driver, a ball was hit at a head speed of 37 m/sec. (LHS) and 45 m/sec. (HHS). The carry and total distance were measured.

Durability

Using a hitting machine of the flywheel type, a ball was repeatedly hit at a head speed (tangential speed) of 38 m/sec. The durability is expressed by the number of hits until ball failure.

Feel

A panel of golf experts made an organoleptic evaluation as to a feel upon hitting a ball. Ratings are as shown below.

Control

A panel of golf experts made an organoleptic evaluation as to ball control upon hitting. Ratings are as shown below.

Organoleptic ratings

E: excellent
G: good
F: fair
P: poor

TABLE 1

| | Ex 1 | Ex 2 | Ex 3 | Ex 4 |
|---|---|---|---|---|
| Solid Core Composition (pbw) | | | | |
| Inner layer | | | | |
| Cis-polybutadiene | 100 | 100 | 100 | 100 |
| Zinc acrylate | 20 | 20 | 20 | 35 |
| Zinc oxide | 160 | 100 | 60 | 19 |
| Dicumyl peroxide | 1 | 1 | 1 | 1 |
| Antioxidant | 0.1 | 0.1 | 0.1 | 0.1 |
| Outer layer | | | | |
| Cis-polybutadiene | 100 | 100 | 100 | — |
| Zinc acrylate | 20 | 35 | 35 | — |
| Zinc oxide | 10 | 5 | 5 | — |
| Dicumyl peroxide | 1 | 1 | 1 | — |
| Antioxidant | 0.1 | 0.1 | 0.1 | — |
| Cover Composition (pbw) & Properties | | | | |
| Ionomer resin | 100 | 100 | 100 | 100 |
| Titanium dioxide | 3 | 3 | 3 | 3 |
| Thickness (mm) | 2.3 | 2.3 | 2.3 | 2.3 |
| JIS C hardness | 65 | 65 | 65 | 65 |
| Core Properties | | | | |
| Inner layer | | | | |
| Diameter (mm) | 20.0 | 23.0 | 27.0 | 38.0 |
| Specific gravity | 1.85 | 1.56 | 1.35 | 1.15 |
| JIS C hardness | 70 | 70 | 70 | 80 |
| Weight (g) | 8.0 | 10.5 | 14.0 | 34.0 |
| Outer layer | | | | |
| Core diameter* (mm) | 38.0 | 38.0 | 38.0 | — |
| Specific gravity | 1.05 | 1.06 | 1.06 | — |
| JIS C hardness | 70 | 75 | 75 | — |
| Weight (g) | 26.0 | 23.5 | 20.0 | — |
| Performance | | | | |
| Flying performance | | | | |
| LHS. | | | | |
| carry (m) | 176 | 175 | 173 | 176 |
| total (m) | 194 | 191 | 185 | 188 |
| HHS. | | | | |
| carry (m) | 208 | 209 | 205 | 208 |
| total (m) | 222 | 225 | 220 | 222 |
| Durability, hits | 250 | 250 | 180 | 280 |
| Feel | E | E | F | G |
| Control | E | E | F | G |

*core diameter = Inner layer diameter + Outer layer thickness(×2)

Examples 1 and 2 are three-piece solid golf balls within the scope of the invention, Example 3 is a three-piece solid golf ball outside the scope of the invention, and Example 4 is a two-piece solid golf ball outside the scope of the invention. As seen from Table 1, the three-piece solid golf balls of the invention are golf balls featuring a good balance of feel, ball control, durability, and flight performance.

Although some preferred embodiments have been described, many modifications and variations may be made thereto in the light of the above teachings. It is therefore to be understood that within the scope of the appended claims, the invention may be practiced otherwise than as specifically described.

We claim:

1. A three-piece solid golf ball comprising:

a two-piece solid core consisting of an inner layer and an outer layer and a cover enclosing the core, wherein said two-piece solid core consists of the inner layer having a diameter in the range of 15 to 25 mm, a weight in the range of 5 to 12 grams, a specific gravity of 1.56 to 4, and a hardness in the range of 55 to 80 in JIS C hardness scale, and the outer layer having a lower specific gravity than that of the inner layer by 0.5 to 1.5, and said cover having a radial thickness of 1.5 to 2.5 mm.

2. The golf ball of claim 1 wherein said core inner layer has a diameter of 18 to 23 mm, and a hardness of 65 to 75 in JIS C hardness scale.

3. The golf ball of claim 1 wherein said cover has a radial thickness in the range of 1.8 to 2.3 mm.

4. The golf ball of claim 1 wherein said core inner and outer layers are formed of a polybutadiene rubber composition.

5. The golf ball of claim 1 wherein said cover is formed of an ionomer resin composition.

6. The golf ball of claim 5 wherein said cover includes an inorganic filler.

7. The golf ball of claim 1 wherein said outer layer of said core has a hardness in the range of 55 to 75 in JIS C hardness scale.

8. The golf ball of claim 1 wherein said core inner and outer layers are formed of a rubber composition comprising a base rubber, a crosslinking agent, a co-crosslinking agent, and a filler.

* * * * *